US010227768B2

(12) United States Patent
Jarvis

(10) Patent No.: US 10,227,768 B2
(45) **Date of Patent: *Mar. 12, 2019**

(54) RESISTANCE SCREENS FOR USE IN STORM DRAIN FILTRATION SYSTEMS

(71) Applicant: Bio Clean Environmental Services, Inc., Oceanside, CA (US)

(72) Inventor: Ernest Jarvis, Norco, CA (US)

(73) Assignee: Bio Clean Enviornmental Services, Inc., Oceanside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/052,741

(22) Filed: Feb. 24, 2016

(65) Prior Publication Data

US 2016/0168838 A1 Jun. 16, 2016

Related U.S. Application Data

(63) Continuation of application No. 14/051,439, filed on Oct. 10, 2013, now Pat. No. 9,322,155.

(51) Int. Cl.
*E03F 5/06* (2006.01)
*E03F 5/046* (2006.01)
*E03F 5/04* (2006.01)

(52) U.S. Cl.
CPC ..... *E03F 5/046* (2013.01); *E03F 5/0404* (2013.01); *E03F 5/06* (2013.01); *E03F 2005/061* (2013.01)

(58) Field of Classification Search
CPC . E03F 5/0404; E03F 5/046; E03F 5/06; E03F 2005/061
USPC .... 210/131, 156, 162, 163, 170.03; 404/4, 5
See application file for complete search history.

(56) References Cited

U.S. PATENT DOCUMENTS

| | | | | |
|---|---|---|---|---|
| 248,559 | A | 10/1881 | Jackson | |
| 1,245,903 | A | 11/1917 | Gross | |
| 4,081,374 | A * | 3/1978 | Forshee | B01D 35/28 210/162 |
| 6,217,756 | B1 | 4/2001 | Martinez | |
| 7,467,911 | B2 | 12/2008 | Flury | |
| 7,491,338 | B2 | 2/2009 | Nino | |
| 7,951,291 | B2 | 5/2011 | Nino | |
| 8,277,645 | B2 | 10/2012 | Jarvis, Jr. et al. | |
| 9,151,033 | B2 | 10/2015 | Jarvis | |
| 9,322,155 | B2 | 4/2016 | Jarvis | |
| 2004/0069697 | A1* | 4/2004 | Martinez | E03F 5/046 210/163 |
| 2009/0208289 | A1 | 8/2009 | Flury | |
| 2009/0236293 | A1 | 9/2009 | Alvarado | |
| 2013/0008842 | A1 | 1/2013 | Jarvis, Jr. et al. | |
| 2013/0008851 | A1 | 1/2013 | Jarvis, Jr. et al. | |
| 2015/0101971 | A1 | 4/2015 | Jarvis | |
| 2015/0259896 | A1 | 9/2015 | Jarvis | |
| 2017/0022696 | A1* | 1/2017 | Jarvis | E03F 5/046 |

* cited by examiner

*Primary Examiner* — Christopher Upton
(74) *Attorney, Agent, or Firm* — Steven W. Webb

(57) ABSTRACT

Embodiments of the disclosure provide resistance hanging screens, configured for installation into a storm drain or a component of a storm drain, that comprise a front plate and first and second hanging pivots. The combination of the location of the center of gravity of the resistance hanging screens and the first and second hanging pivots confers a bias of the resistance hanging screens to occupy a closed position when the resistance hanging screen is installed in the storm drain or the storm drain component.

13 Claims, 6 Drawing Sheets

RESISTANCE SCREENS FOR USE IN STORM DRAIN FILTRATION SYSTEMS

CROSS REFERENCE TO RELATED APPLICATIONS

This application claims priority to U.S. patent application Ser. No. 14/051,439, filed Oct. 10, 2013, entitled "RESISTANCE SCREENS FOR USE IN STORM DRAIN FILTRATION SYSTEMS," the contents of which are hereby incorporated by reference in their entirety.

TECHNOLOGICAL FIELD

The present invention relates to resistance screens for use in various types of storm drain filters including connector pipe screens and curb inlet filters, such as curb inlet automatically retractable screens and connector pipe screens.

BACKGROUND

Primary functions of storm water conveyance systems include the prevention of erosion and flooding by channeling surface water runoffs into networks of underground pipes and/or open channels for controlled distribution. Surface water runoffs taken into storm water conveyance systems can be directed to water treatment facilities and/or open bodies of water, such as rivers, lakes, and oceans. Storm drains represent the intake point of surface water runoffs into the storm water conveyance system.

Surface water runoff enters a storm drain through an opening called a storm drain inlet. Typically, the storm drain inlet allows water to run into a catch basin. And the catch basins has an intake opening and an outlet pipe that provides a path for water to run from the catch basin into the remainder of the storm water conveyance system.

Debris removal is an important function of storm drain filtration systems because debris entering storm drains along with surface water runoff may clog storm drains, resulting in flooding, or run through storm drains, resulting in damage to water treatment facilities and/or pollution of receiving water bodies. Storm drains can incorporate a variety of filter systems designed to reduce the amount of debris that enters the storm drain and/or the storm water conveyance system. Examples of such filtering systems include storm drain inlet screens, catch basin filters, pre-treatment filters, and connector pipe screens.

While storm drain filtration systems should inhibit debris and trash from entering into the storm drain and/or storm water conveyance system, they should not interfere with the primary functions of the conveyance system, which is the prevention of erosion and flooding. One strategy for achieving these objectives are storm drain filtration systems comprising screens that occupy a closed position under dry conditions, or conditions of low or moderate water flow, and an open position under conditions of moderate to heavy water flow. In such systems, screens in the closed position impede the passage of debris while permitting low to moderate water flow; and screens in the open position allow the passage of debris and water such that the screens themselves do not plug the storm drains and cause flooding.

In the context of curb inlet filtration units, debris detained by such screens when there is no, low, or moderate water flow can be removed by a street sweeper, keeping the removed debris out the storm drain and the storm water conveyance system. In the context of connector pipe filtration units, debris detained by such screens when there is low to moderate water flow can be removed from the catch basin of the storm drain by maintenance crews, keeping the removed debris out of the remainder of the storm drain and/or storm water conveyance system.

An inherent problem with known devices such as in the Jarvis patent is that the screen has an open configuration bias, such that the described curb inlet filtration unit has a high failure rate.

SUMMARY

It is an object of this invention to provide hanging screens, for use in a variety of storm drains, that are naturally and positively closed during periods of no, low, or moderate surface runoff water flow into, through, or out of storm drains, and reliably open when such flow rates increase to moderate or high flow levels.

Certain embodiments of the invention provide resistance hanging screens, configured for installation into a storm drain or a component of a storm drain, that comprise: a front screen, a first hanging pivot, a first hanging pivot attachment member, a second hanging pivot, and a second hanging pivot attachment member. Such resistance hanging screens have the following features. The front screen comprises a substantially rectangular or square shape. The first hanging pivot attachment member attaches the first hanging pivot to the front screen such that: i. the first hanging pivot is positioned frontward of the front screen, and ii. at least a portion of a shaft of the first hanging pivot extends away from the front screen at a substantially right angle to a first lateral side of the front screen. The second hanging pivot attachment member attaches the second hanging pivot to the front screen such that: i. the second hanging pivot is positioned frontward of the front screen, and ii. at least a portion of a shaft of the second hanging pivot extends away from the front screen at a right angle to a second lateral side of the front screen. The first and second hanging pivots are configured to swingably mount the resistance hanging screen into the storm drain or the component of the storm drain. A center of gravity of the resistance hanging screen is located in a space between a surface of a frontward side of the front screen and a plane that: i. runs parallel to the frontward side of the front screen, and ii. bisects the first hanging pivot and the second hanging pivot. And the location of the center of gravity results in the resistance hanging having a bias towards occupying a closed position when the resistance hanging screen is installed in the storm drain or the storm drain component.

In some embodiments, at least one of the front screen, the first hanging pivot, the first hanging pivot attachment member, the second hanging pivot, and the second 2 is made from stainless steel.

In some embodiments, the front screen comprises a plurality of perforations having diameters of at least about ½ inch, and the perforations are positioned on the front screen in a staggered pattern.

In some embodiments, the bias towards occupying a closed position is overcome by exerting, in a frontward to rearward direction and within a bottom most quarter section of the front screen, a pressure of about 14 psi on the front screen.

Certain embodiments of the present invention provide resistance hanging screens, configured for installation into a storm drain or a component of a storm drain, that comprise a front screen, a first hanging pivot, a second hanging pivot, a counterbalance weight, and a counterbalance weight attachment member. Such resistance hanging screens have the following features. The front screen comprises a substantially rectangular or square shape. The first hanging pivot is mounted on a first lateral side of the front screen such that at least a portion of a shaft of the first hanging pivot extends away from the front screen at a right angle to the first lateral side. The second hanging pivot is mounted on a second lateral side of the front screen such that at least a portion of a shaft of the second hanging pivot extends away from the front screen at a substantially right angle to the second lateral side. The first and second hanging pivots are configured to swingably mount the resistance hanging screen into the storm drain or the component of the storm drain. The counterbalance weight attachment member attaches the counterbalance weight to the front screen at a position rearward of the front screen such that a center of gravity of the resistance hanging screen is located in a space between a surface of a rearward side of the front screen and a plane that: i. runs parallel to the rearward side of the front screen, and ii. bisects the counterbalance weight. And the location of the center of gravity results in the resistance hanging screen having a bias towards occupying a closed position when the resistance hanging screen is installed in the storm drain or the storm drain component.

In some embodiments, at least one of the front screen, the first hanging pivot, the second hanging pivot, the counterbalance weight, and the counterbalance weight attachment member is made from stainless steel.

In some embodiments, the front screen comprises a plurality of perforations and having diameters of at least about ½, and the perforations are positioned on the front screen in a staggered pattern.

In some embodiments, the bias towards occupying a closed position is overcome by exerting, in a frontward to rearward direction and within a bottom most quarter section of the front screen, a pressure of about 14 psi on the front screen.

As used herein, the term "frontward" refers to the side of a resistance screen or a component of a resistance screen from which water that passes through it approaches. As used herein, the term "rearward" refers to the side opposite the frontward side of a resistance screen or a component of a resistance screen.

An aspect of the disclosure provides a device for screening storm water entering a storm drain. The device can have a front screen having front side, a back side opposite the front side, a first side panel, a second side panel opposite the first side panel, and a plurality of perforations. The device can also have a pair of hanging pivot mounting plates. Each hanging pivot mounting plate of the pair of hanging pivot mounting plates can be coupled to one of the first side panel and the second side panel. Each hanging pivot mounting plate can extend away from the front side. The device can also have a pair of hanging pivots. Each hanging pivot of the pair of hanging pivots can be engaged with one hanging pivot mounting plate of the pair of hanging pivot mounting plates. Each hanging pivot can extend in opposite directions and away from the respective first side panel and second side panel.

Another aspect of the disclosure can provide a device for screening storm water entering a storm drain. The device can have a front screen having front side, a back side opposite the front side, a first side panel, a second side panel opposite the first side panel, and a plurality of perforations. The device can also have a first hanging pivot mounting plate coupled to the first side panel and extending forward and away from the front side. The device can also have a second hanging pivot mounting plate coupled to the second side panel and extending forward and away from the front side. The device can also have a first hanging pivot coupled to the first hanging pivot mounting plate. The device can also have a second hanging pivot coupled to the second hanging pivot mounting plate. The first hanging pivot and the second hanging pivot can extend in opposite directions outward and away from the respective first side panel and second side panel to define a swing axis.

DETAILED DESCRIPTION

Figure 1A:
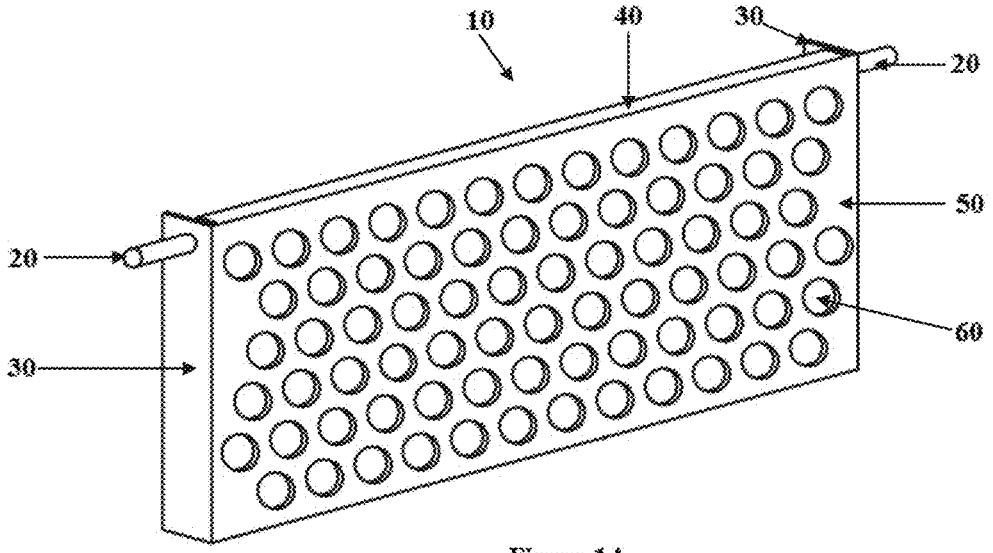
FIG. 1A is a front elevation view of a prior art curb inlet hanging filter screen.
Figure 1B:
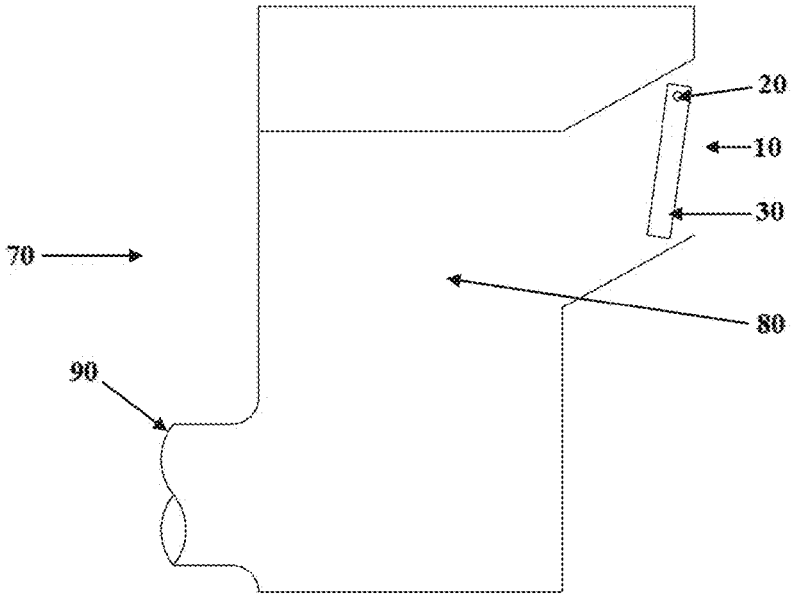
PRIOR ART Figure 1B
FIG. 1B is a side view of a storm drain with the prior art curb inlet hanging filter screen shown in FIG. 1A installed.

FIG. 1A is a front elevation view of a prior art curb inlet hanging screen 10 that comprises hanging pivots 20, side plates 30, top plate 40, front screen 50, and front screen perforations 60. Prior art curb inlet screen 10 is made of metal, such as steel or stainless steel. FIG. 1B is a side view of a storm drain 70 that comprises prior art curb inlet screen 10, a catch basin 80, and a connector pipe 90. Prior art curb inlet screen 10 is swingably mounted in storm drain 70 by hanging pivots 20. A majority of the mass of prior art curb inlet screen 10 resides in front screen 50 and hanging pivots 20 are positioned rearward of front plate 50. Accordingly, the center of gravity of prior art curb inlet screen 10 is located between front screen 50 and a plane that runs parallel to a broad face of front screen 50 and that bisects hanging pivots 20.

The combination of having a so-located center of gravity and being swingably mounted in storm drain 70 results in prior art curb inlet screen 10 having a bias toward an open position when mounted in a hanging fashion into storm drain 70, as shown in FIG. 1B. Such an open position bias results in prior art curb inlet screen 10 having a tendency to open or remain open under any conditions, including dry conditions or conditions of low to moderate water flow through the curb inlet screen. In an open position, debris is free to enter storm drain 70, rendering curb inlet screen 10 non-operative for its intended filtering function.

Figure 2A:
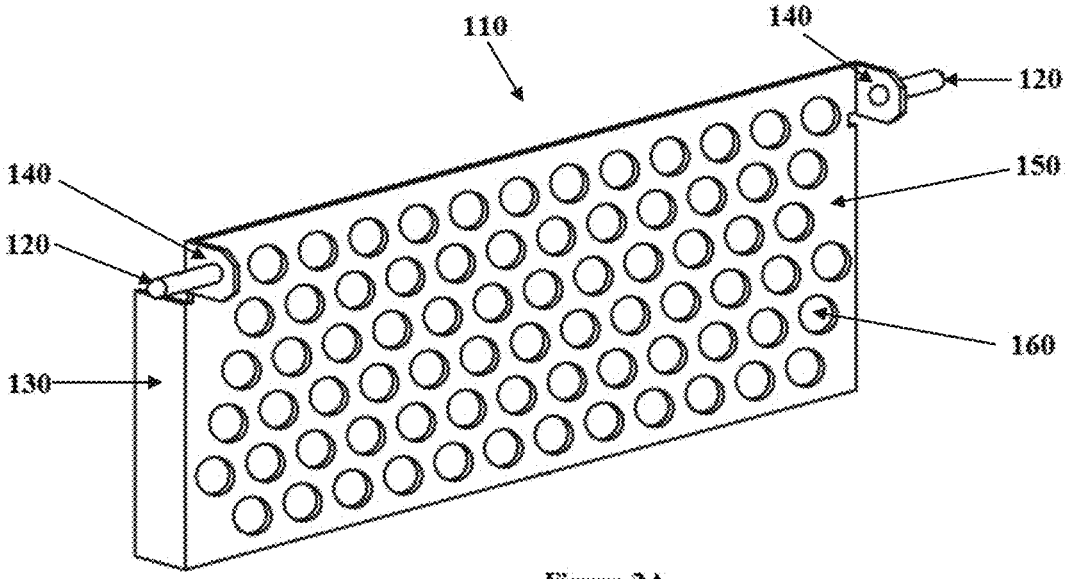
FIG. 2A is a front elevation view of a resistance hanging screen according to the invention that comprises forward positioned hanging pivots.
Figure 2B:
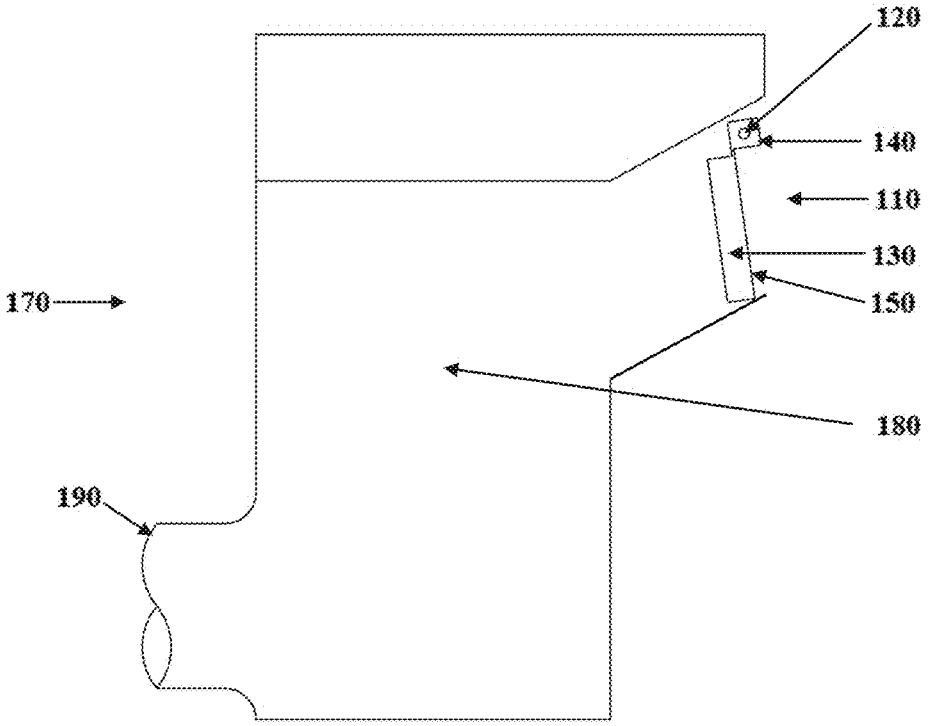
FIG. 2B is a side view of a storm drain with the resistance hanging screen illustrated in FIG. 2A installed as a curb inlet filter.

FIG. 2A is a front elevation view of a storm drain resistance hanging screen 110 according to the present invention. Resistance hanging screen 110 comprises hanging pivots 120, side plates 130, hanging pivot mounting plates 140, front screen 150, and front screen perforations 160. Resistance hanging screen 110 is made of metal, such as steel or stainless steel. FIG. 2B is a side view of a storm drain 170 that comprises resistance hanging screen 110, a catch basin 180, and a connector pipe 190. Resistance hanging screen 110 is swingably mounted in storm drain 170 by hanging pivots 120. A majority of the mass of resistance hanging screen 110 resides in front screen 150 and side plates 130. Hanging pivots 120 are positioned frontward of front screen 150 and side plates 130 (FIG. 2A). Accordingly, the center of gravity of resistance hanging screen 110 is located between front screen 150 and a plane that is perpendicular to side plates 130 and that bisects hanging pivots 120.

The combination of having a so-located center of gravity and being swingably mounted in storm drain 170 results in resistance hanging screen 110 having a bias toward a closed position when mounted in a hanging fashion in storm drain 170, as shown in FIG. 2B. Such a closed position bias results in resistance hanging screen 110 having a tendency to remain closed under dry conditions and conditions of low to moderate water flow. With low to moderate water flow, the pressure exerted on front screen 150 is insufficient to overcome the closed position bias of resistance hanging screen 110. In a closed position, debris is impeded from entering storm drain 170. Accordingly, resistance hanging screen 110 reliably assumes a closed position in dry conditions and in conditions of low to moderate water flow therethrough; and is therefore reliably operative for its intended filtering function.

At the same time, moderate to high water flows through resistance hanging screen 110 exerts pressure on front screen 150 sufficient to cause resistance hanging screen 110 to swing on hanging pivots 120 into an open position (not shown). In the open position significantly increased amounts of water flow into catch basin 180 than would flow if resistance hanging screen 110 were fixedly mounted into storm drain 170 in a closed position. In this way, resistance hanging screen 110 assists storm drain 170 to perform its primary functions of preventing erosion and flooding by channeling surface water runoffs into networks of underground pipes and/or open channels for controlled distribution. Upon abatement of moderate to high water flow, resistance hanging screen 110 swings with bias on hanging pivots 120 into the closed position.

In some embodiments according to the present invention, resistance hanging screen side plates, hanging pivot mounting plates, and front screens are formed into configurations the same or substantially similar to that illustrated in FIG. 2A by bending a single piece of appropriately-shaped metal. In some embodiments according to the present invention, resistance hanging screen side plates, hanging pivot mounting plates, and front screens are formed into configurations the same or substantially similar to that illustrated in FIG. 2A not by bending a single piece of metal, but rather by joining together two or more sheets of metal, which have been cut, filed, molded, sanded, bent, etc. into subcomponent parts, by weld(s), bracket(s), screw(s), pivot(s), rivet(s), and the like.

Figure 3:
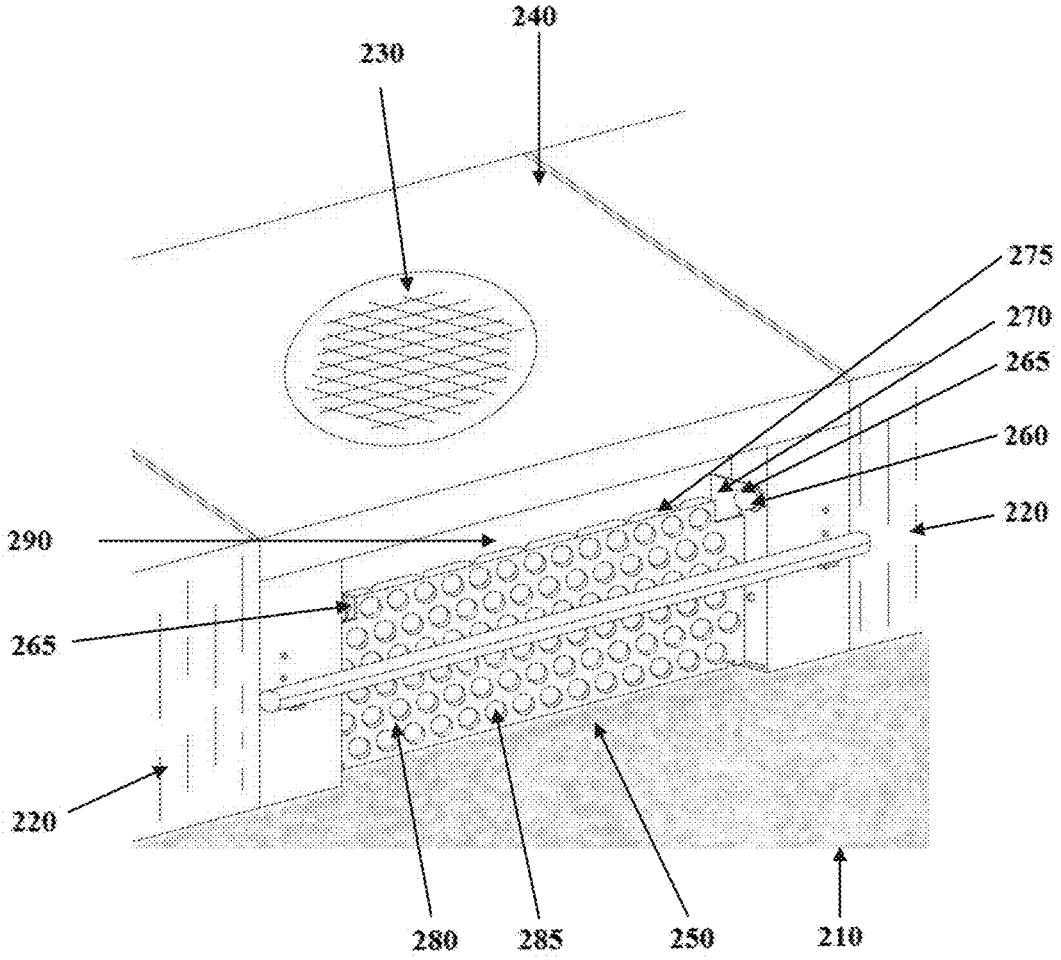
FIG. 3 is a front elevation view of a storm drain installed in a sidewalk, the storm drain comprising the resistance screen illustrated in FIG. 2A installed as a curb inlet filter.

FIG. 3 is an elevated view of a sidewalk 240 with a storm drain manhole cover 230 and a curb face 220 bordering roadway 210. A storm drain inlet opening in curb 220 is partially occupied by an embodiment of a storm drain resistance hanging screen 250 according to the invention configured as a storm drain curb inlet screen. Resistance hanging screen 250 comprises hanging pivots 260, hanging pivot mounting plates 265, side plates 270, notched top plate 275, front screen 280, and front screen perforations 285. Built in overflow area 290 provides emergency overflow should front screen 280 become clogged with debris. Resistance hanging screen 250 is made of metal, such as steel or stainless steel.

Resistance hanging screen 250 is swingably mounted in the storm drain inlet opening in curb face 220 by hanging pivots 260. A majority of the mass of resistance hanging screen 250 resides in front screen 280 and side plates 270. Hanging pivots 260 are positioned frontward of front screen 280 and side plates 270. Accordingly, the center of gravity of resistance hanging screen 250 is located between front screen 280 and a plane that is perpendicular to side plates 270 and that bisects hanging pivots 260.

The combination of having a so-located center of gravity and being swingably mounted in the storm drain inlet opening in curb face 220 results in resistance hanging screen 250 having a bias toward the illustrated closed position when mounted in a hanging fashion in the storm drain inlet opening in curb face 220, as shown. Such a closed position bias results in resistance hanging screen 250 having a tendency to remain closed under dry conditions and conditions of low to moderate water flow therethrough. With low to moderate water flow, the pressure exerted on front screen 280 is insufficient to overcome the closed position bias of resistance hanging screen 250. In a closed position, debris is impeded from entering the storm drain inlet opening in curb face 220. Accordingly, resistance hanging screen 250 reliably assumes a closed position in dry conditions and in conditions of low to moderate water flow therethrough; and is therefore reliably operative for its intended filtering function.

At the same time, moderate to high water flows through resistance hanging screen 250 exert pressure, mostly on front screen 280, sufficient to cause resistance hanging screen 250 to swing on hanging pivots 260 into an open position (not shown). In the open position significantly increased amounts of water flow into the storm drain inlet opening in curb face 220 than would flow if resistance hanging screen 250 were fixedly mounted into the storm drain inlet opening in curb face 220 in a closed position. In this way, the resistance hanging screen 250 assists the storm drain inlet opening in curb face 220 to perform its primary functions of preventing erosion and flooding by channeling surface water runoffs into networks of underground pipes and/or open channels for controlled distribution. Upon abatement of moderate to high water flow, resistance hanging screen 250 swings with bias on hanging pivots 260 into the closed position.

Figure 4:
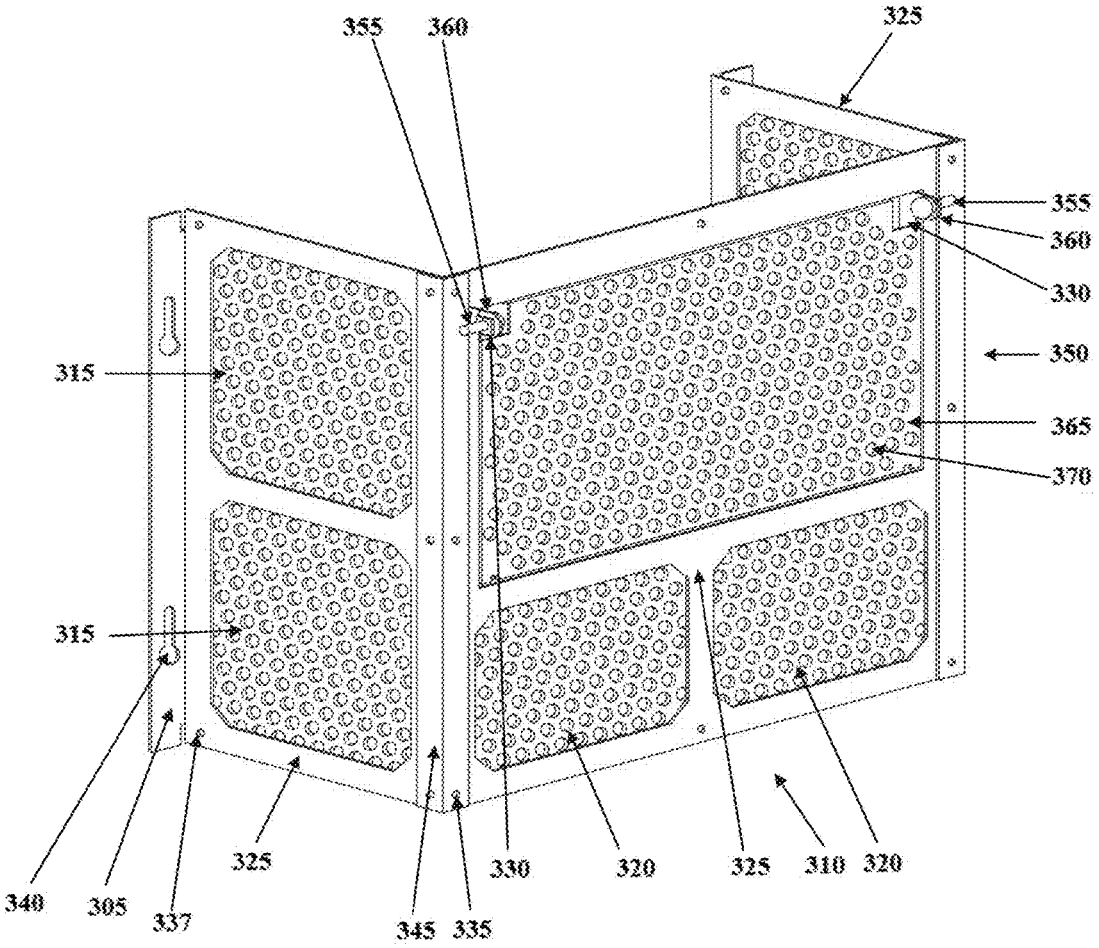
FIG. 4 is an illustration of a resistance hanging screen according to the invention that comprises forward positioned hanging pivots in a storm drain connector pipe screen.

FIG. 4 is an elevated view of an embodiment of a storm drain resistance hanging screen 350 according to the invention in a storm drain connector pipe screen 310. Connector pipe screen 310 comprises, in addition to resistance hanging screen 350, side screens 315, lower front screens 320, frame 325, frame reinforcement members 345, frame hanging pivot receptor assemblies 330, and storm drain connector pipe screen wall mounting members 305 that comprise wall attachment openings 340. Storm drain wall attachment openings 340 are adapted to receive mounting hardware, such as bolts, screws, and the like, (not shown) that fixedly attach connector pipe screen 310 to a storm drain wall (not shown) that comprises an opening for a storm drain connector pipe. Storm drain connector pipe screen mounting members 305 are fixedly attached to frame 325. Frame reinforcement members 345 are fixedly attached to frame 325 by frame reinforcement rivets or screws 335. Side screens 315, lower front screens 320, and hanging pivot receptor assemblies 330 are each fixedly attached to frame 325 by welds. In some embodiments, side screens 315, lower front screens 320, hanging pivot receptor assemblies 330, and frame reinforcement members 345 are each fixedly attached to frame 325 by means that include, without limitation, one or more of rivet(s), bolt(s), screw(s), and the like.

Referring again to FIG. 4, resistance hanging screen 350 comprises hanging pivots 355, hanging pivot mounting plates 360, front screen 365, and front screen perforations 370. The connector pipe screen 310 is made of metal, such as steel or stainless steel.

Resistance hanging screen 350 is swingably mounted in hanging pivot receptor assemblies 330 by hanging pivots 355. A majority of the mass of resistance hanging screen 350 resides in front screen 365. Hanging pivots 355 are positioned frontward of front screen 365. Accordingly, the center of gravity of resistance hanging screen 350 is located between front screen 365 and a plane that is parallel to front plate 365 and a plane that bisects hanging pivots 355.

The combination of having a so-located center of gravity and being swingably mounted in the storm drain storm drain connector pipe screen 310 results in resistance hanging screen 350 having a bias toward the illustrated closed position when mounted in a hanging fashion in connector pipe screen 310, as shown. Such a closed position bias results in resistance hanging screen 350 having a tendency to remain closed under dry conditions and conditions of low to moderate water flow. With low to moderate water flow, the pressure exerted on front screen 365 is insufficient to overcome the closed position bias of resistance hanging screen 350. In a closed position, debris is impeded from entering a storm drain connector pipe (not shown) located behind connector pipe screen 310. Accordingly, resistance hanging screen 350 reliably assumes a closed position in dry conditions and in conditions of low to moderate water flow therethrough; and is therefore reliably operative for its intended filtering function.

Figure 5A:
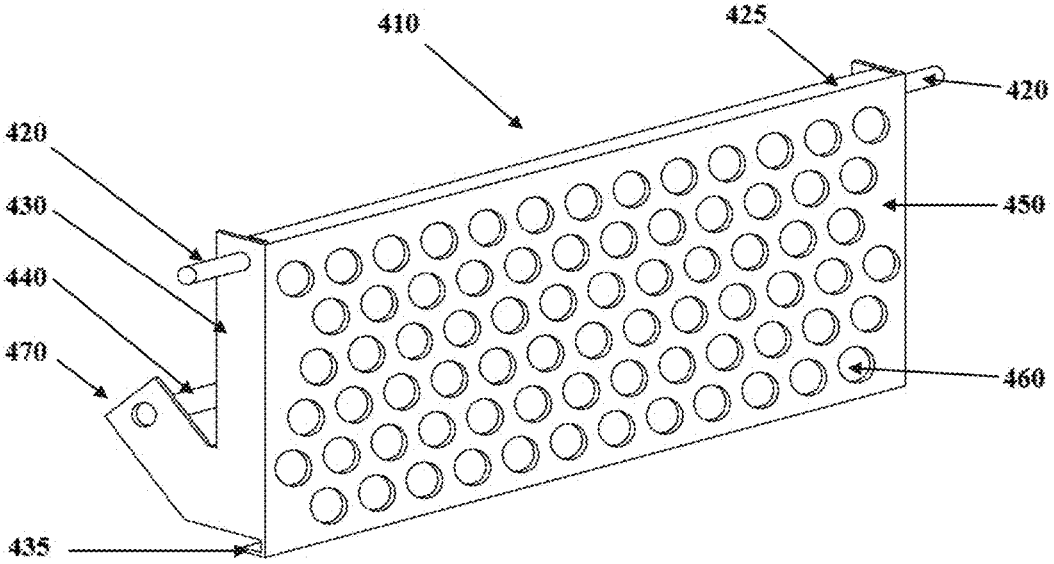
FIG. 5A is a front elevation view of a resistance hanging screen according to the invention that comprises a counterbalance assembly.
Figure 5B:
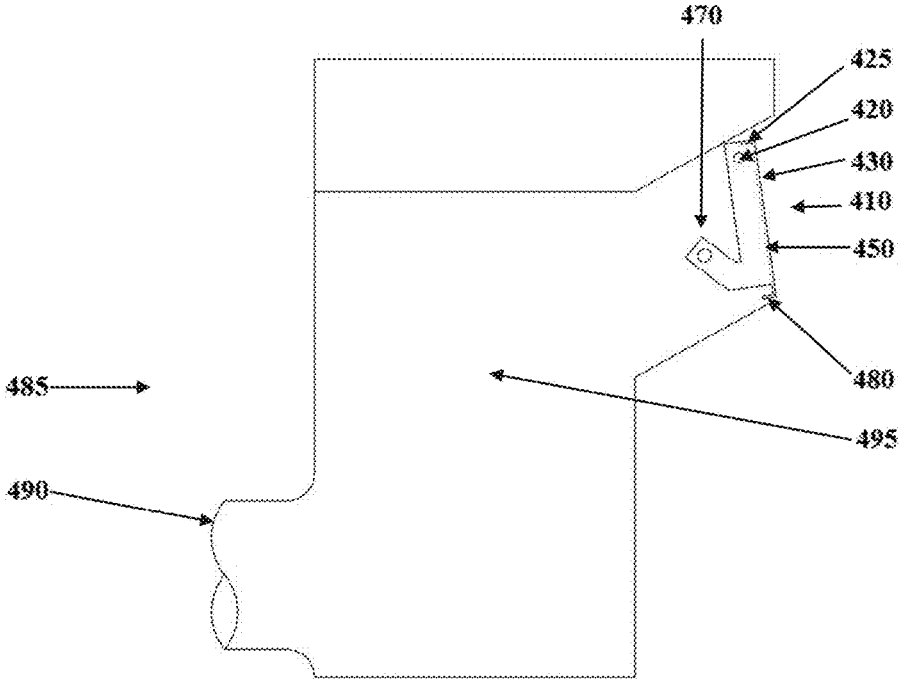
FIG. 5B is a side view of a storm drain with the resistance hanging screen illustrated in FIG. 5A installed as a curb inlet filter.

At the same time, moderate to high water flows through resistance hanging screen 350 exert pressure, mostly on front screen 365, sufficient to cause resistance hanging screen 350 to swing on hanging pivots 355 into an open position (not shown). In the open position significantly increased amounts of water flow into the storm drain connector pipe (not shown) than would flow if resistance hanging screen 350 were fixedly mounted to the connector pipe screen 310 in a closed position. In this way, resistance hanging screen 350 assists the storm drain into which connector pipe screen 310 is installed to perform its primary functions of preventing erosion and flooding by channeling surface water runoffs into networks of underground pipes and/or open channels for controlled distribution. Upon abatement of moderate to high water flow, resistance hanging screen 350 swings with bias on hanging pivots 355 into the closed position FIG. 5A is a front elevation view of a storm drain resistance hanging screen 410 according to an alternate embodiment of the present invention. Resistance hanging screen 410 comprises hanging pivots 420, top plate 425, side plates 430, bottom plate 435, counterbalance 440, front screen 450, and front screen perforations 460. Counterbalance assembly 470 is comprised of counterbalance 440 and the portion of side plates 430 that are rearward of a plane that bisects both the center of mounting pivots 420 and the top edges of side plates 430. Resistance hanging screen 410 is made of metal, such as steel or stainless steel. FIG. 5B is a side view of a storm drain 485 that comprises resistance hanging screen 410, a catch basin 495, and a connector pipe 490. Resistance hanging screen 410 is swingably mounted in storm drain 485 by hanging pivots 420. A majority of the mass of resistance hanging screen 410 resides in counterbalance assembly 470. Accordingly, the center of gravity of resistance hanging screen 410 is located behind a plane that bisects both the openings of side plates 430 that receive mounting pivots 420 and the top edges of side plates 430.

The combination of having a so-located center of gravity and being swingably mounted in storm drain 485 results in resistance hanging screen 410 having a bias toward a closed position when mounted in a hanging fashion in storm drain 485, as shown in FIG. 5B. Such a closed position bias results in resistance hanging screen 410 having a tendency to remain closed under dry conditions and conditions of low to moderate water flow. With low to moderate water flow, the pressure exerted on front screen 450 is insufficient to overcome the closed position bias of resistance hanging screen 410. In a closed position, debris is impeded from entering storm drain 485. Accordingly, resistance hanging screen 410 reliably assumes a closed position in dry conditions and in conditions of low to moderate water flow therethrough; and is therefore reliably operative for its intended filtering function.

At the same time, moderate to high water flows through resistance hanging screen 410 exerts pressure on front screen 450 sufficient to cause resistance hanging screen 410 to swing on hanging pivots 420 into an open position (not shown). In the open position significantly increased amounts of water flow into catch basin 485 than would flow if resistance hanging screen 410 were fixedly mounted into storm drain 485 in a closed position. In this way, the resistance hanging screen 410 assists storm drain 485 to perform its primary functions of preventing erosion and flooding by channeling surface water runoffs into networks of underground pipes and/or open channels for controlled distribution. Upon abatement of moderate to high water flow, resistance hanging screen 410 swings with bias on hanging pivots 420 into the closed position.

In some embodiments according to the present invention, resistance hanging screen top plates, side plates, bottom plates, counterbalances, and front screens are formed into configurations the same or substantially similar to that illustrated in FIG. 5A by cutting a single piece of appropriately-shaped metal. In some embodiments according to the present invention, resistance hanging screen top plates, side plates, bottom plates, counterbalances, and front screens are formed into configurations the same or substantially similar to that illustrated in FIG. 5A not by bending a single piece of metal, but rather by joining together two or more sheets of metal, which have been cut, filed, molded, sanded, bent, etc. into subcomponent parts, by weld(s), bracket(s), screw (s), pivot(s), rivet(s), and the like.

Figure 6:
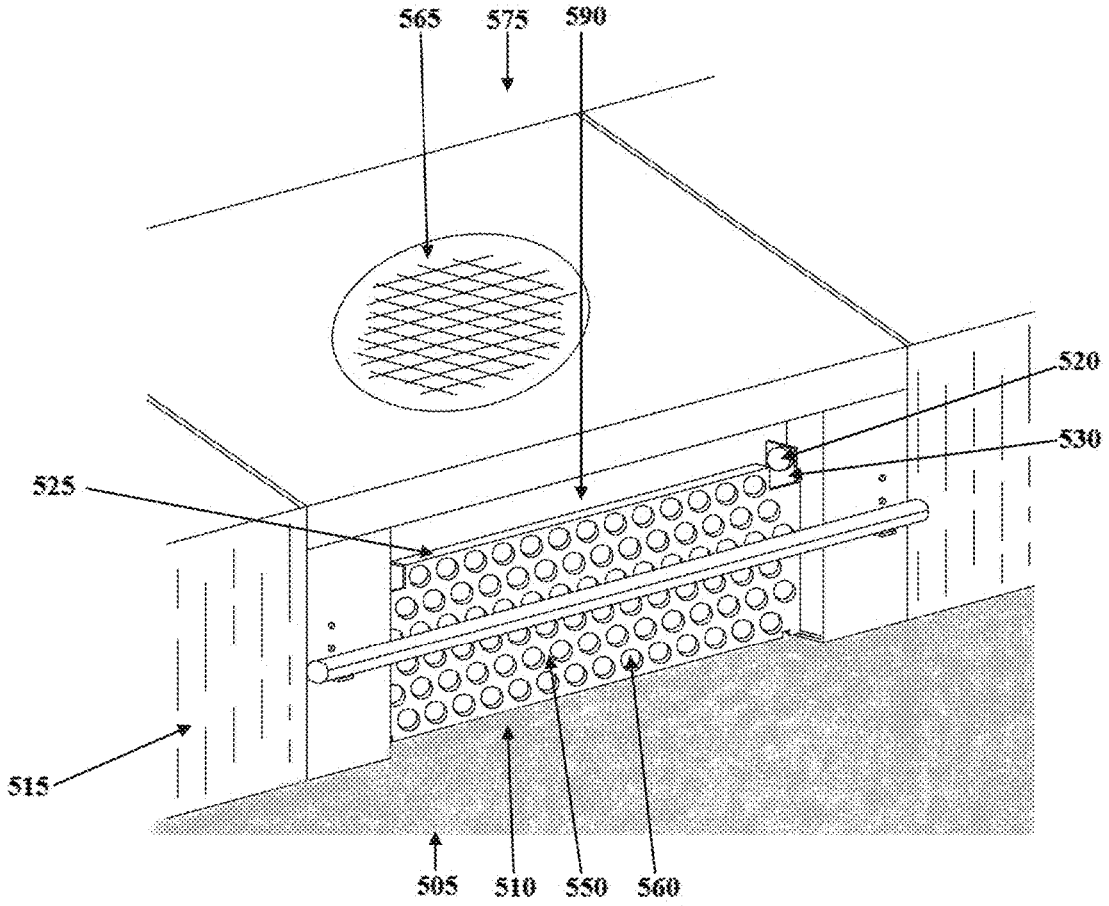
FIG. 6 is a front elevation view of a storm drain installed in a sidewalk, the storm drain comprising the resistance screen illustrated in FIG. 5A installed as a curb inlet filter.

FIG. 6 is an elevated view of a sidewalk 575 with a storm drain manhole cover 565 and a curb face 515 bordering roadway 505. A storm drain inlet opening in curb 515 is partially occupied by an embodiment of a storm drain resistance hanging screen 510 that comprises a counterbalance assembly according to the invention configured as a storm drain curb inlet screen. Resistance hanging screen 510 comprises hanging pivots 520, top plate 525, side plates 530, bottom plate (not shown), counterbalance (not shown), front screen 550, and front screen perforations 560. Counterbalance assembly (not shown) is comprised of a counterbalance (not shown) and the portion of side plates 530 that are rearward of a plane that bisects both the openings of side plates 530 that receive mounting pivots 520 and the top edges of side plates 530. Built in overflow area 590 provides emergency overflow should front screen 550 become clogged with debris. Resistance hanging screen 510 is made of metal, such as steel or stainless steel.

Resistance hanging screen 510 is swingably mounted in the storm drain inlet opening in curb face 515 by hanging pivots 520. A majority of the mass of resistance hanging screen 510 resides in counterbalance assembly (not shown). Accordingly, the center of gravity of resistance hanging screen 510 is located behind a plane that bisects both the openings of side plates 530 that receive mounting pivots 520 and the top edges of side plates 530.

The combination of having a so-located center of gravity and being swingably mounted in the storm drain inlet opening in curb face 515 results in resistance hanging screen 510 having a bias toward the illustrated closed position when mounted in a hanging fashion in the storm drain inlet opening in curb face 515, as shown. Such a closed position bias results in resistance hanging screen 510 having a tendency to remain closed under dry conditions and conditions of low to moderate water flow therethrough. With low to moderate water flow, the pressure exerted on front screen 550 is insufficient to overcome the closed position bias of resistance hanging screen 510. In a closed position, debris is impeded from entering the storm drain inlet opening in curb face 515. Accordingly, resistance hanging screen 510 reliably assumes a closed position in dry conditions and in conditions of low to moderate water flow therethrough; and is therefore reliably operative for its intended filtering function.

At the same time, moderate to high water flows through resistance hanging screen 510 exert pressure, mostly on front screen 550, sufficient to cause resistance hanging screen 510 to swing on hanging pivots 520 into an open position (not shown). In the open position significantly increased amounts of water flow into the storm drain inlet opening in curb face 515 than would flow if resistance hanging screen 510 were fixedly mounted into the storm drain inlet opening in curb face 515 in a closed position. In this way, the resistance hanging screen 510 assists the storm drain inlet opening in curb face 515 to perform its primary functions of preventing erosion and flooding by channeling surface water runoffs into networks of underground pipes and/or open channels for controlled distribution. Upon abatement of moderate to high water flow, resistance hanging screen 510 swings with bias on hanging pivots 520 into the closed position.

Storm drain resistance hanging screens of the invention are customizable with respect to size and shape in order to achieve resistance hanging screens tailored to perform a particular function (e.g., a storm drain curb inlet filter or a storm drain connector pipe screen) and to fit a particular storm drain into which the resistance screens will be installed. In some embodiments, resistance hanging screens comprising a counterbalance assembly are adapted for installation into a connector pipe screen. In addition, the materials from which resistance hanging screens of the invention may be fabricated to include any metal, alloy, and the like that confers sufficient strength upon the resistance hanging screen to perform its intended function. Useful metals include steel, such as galvanized steel and stainless steel.

Storm drain resistance hanging screens of the invention comprise perforations that allow water to flow therethrough. Perforations may be of any functional shape, such as circular, oval, square, diamond, rectangular, triangular, and the like. In addition, perforations may be of any size suitable for the resistance hanging screen to achieve its intended function of impeding debris from entering storm drains and/or the downstream sewer system while at the same time assisting storm drains in achieving their primary purposes of preventing erosion and flood control. In some embodiments, substantially evenly spaced front screen perforations having diameters ranging from approximately ½ inch to ¾ inch cover approximately 30%, 40%, 50%, or 60% of the front screen.

The degree to which a resistance hanging screen of the invention is biased to a closed position is customizable by, for instance and without limitation, manipulating the weight of the front screen and/or a counterbalance and/or the distance the pivots of a hanging screen are positioned frontward of its center of gravity. Useful biases toward the closed position for resistance hanging screens of the invention include those in which a resistance hanging screen maintains a closed position until subjected to a pressure, from a frontward to rearward direction, of at least about 10 psi, about 14 psi, about 20 psi, and about 25 psi, e.g. by water passing through the resistance hanging screen. Upon exposure to such pressures, the resistance hanging screen will swing on hanging pivots into an open position, the degree of openness increasing with increasing water flow. Upon abatement of such water flows the resistance screen will swing with bias on hanging pivots into the closed position.

Pivots useful in storm drain resistance hanging screens of the invention include bolts, rods, pins, and commercial hardware such as Buckeye pins.

The skilled artisan will recognize the interchangeability of various features from different embodiments. Although the disclosure has been provided in the context of certain embodiments and examples, it will be understood by those skilled in the art that the disclosure extends beyond the specifically described embodiments to other alternative embodiments and/or uses and obvious modifications and equivalents thereof. Accordingly, the disclosure is not intended to be limited by the specific disclosures of embodiments herein.

What is claimed is:

1. A device for screening storm water entering a storm drain, the device comprising:

a front screen having front side, a back side opposite the front side, a first side panel, a second side panel opposite the first side panel, and a plurality of perforations;

a pair of hanging pivot mounting plates, each hanging pivot mounting plate of the pair of hanging pivot mounting plates coupled to one of the first side panel and the second side panel, each hanging pivot mounting plate extending away from the front side;

a pair of hanging pivots, each hanging pivot of the pair of hanging pivots engaged with one hanging pivot mounting plate of the pair of hanging pivot mounting plates, each hanging pivot extending in opposite directions and away from the respective first side panel and second side panel.

2. The device of claim 1, wherein each hanging pivot mounting plate is disposed orthogonal to the front side on one of the first side panel and the second side panel, and wherein each of the hanging pivots is disposed orthogonal to each of the hanging pivot mounting plates to define a rotational axis of the device.

3. The device of claim 2, wherein the rotational axis is disposed frontward of the front side, wherein a center of gravity of the device causes a bottom of the front screen to swing forward of and below a top of the front screen when suspended by the pair of hanging pivots.

4. The device of claim 2, wherein the pair of hanging pivots is configured to swingably mount the device in an opening of the storm drain.

5. A device for screening storm water entering a storm drain, the device comprising:

a front screen having front side, a back side opposite the front side, a first side panel, a second side panel opposite the first side panel, and a plurality of perforations;

a first hanging pivot mounting plate coupled to the first side panel and extending forward and away from the front side;

a second hanging pivot mounting plate coupled to the second side panel and extending forward and away from the front side;

a first hanging pivot coupled to the first hanging pivot mounting plate;

a second hanging pivot coupled to the second hanging pivot mounting plate, the first hanging pivot and the second hanging pivot extending in opposite directions outward and away from the respective first side panel and second side panel to define a swing axis.

6. The device of claim 5, wherein the first hanging pivot and the second hanging pivot are configured to allow the device to pivot on the swing axis when installed in an opening of the storm drain.

7. The device of claim 6, wherein a center of gravity of the device causes a bottom of the front screen to swing forward of a top of the front screen when suspended by the first hanging pivot and the second hanging pivot.

8. The device of claim 5, wherein the swing axis is disposed forward of the front side at approximately a top of the front screen.

9. A resistance hanging screen, configured for installation into a storm drain or a component of a storm drain, comprising:

a front screen;

a hanging pivot; and a hanging pivot attachment member, wherein:

the hanging pivot attachment member attaches the hanging pivot to the front screen such that the hanging pivot is positioned frontward of the front screen, and at least a portion of a shaft of the hanging pivot extends away from the front screen at a substantially right angle to a first lateral side of the front screen;

the hanging pivot is configured to swingably mount the resistance hanging screen into the storm drain or the component of the storm drain;

a center of gravity of the resistance hanging screen is located in a space between a surface of a frontward side of the front screen and a plane that runs parallel to the frontward side of the front screen, and bisects the first hanging pivot and the second hanging pivot; and the location of the center of gravity results in the resistance hanging screen having a bias towards occupying a closed position when the resistance hanging screen is installed in the storm drain or the storm drain component.

10. The resistance hanging screen of claim 9, wherein at least one of the front screen, the hanging pivot, the hanging pivot attachment member, the second hanging pivot, and the second hanging pivot attachment member is made from metal, plastic or fiberglass.

11. The resistance hanging screen of claim 9, wherein the front screen comprises a plurality of perforations.

12. The resistance hanging screen of claim 11 wherein the perforations are arranged in a staggered pattern on the front screen, and wherein each perforation of the plurality of perforations have a diameter of one half inch or more.

13. The resistance hanging screen of claim 9, wherein the bias towards occupying a closed position is overcome by exerting, in a frontward to rearward direction and within a bottommost quarter section of the front screen.

* * * * *